US006366258B2

(12) United States Patent
Reece et al.

(10) Patent No.: US 6,366,258 B2
(45) **Date of Patent: *Apr. 2, 2002**

(54) LOW PROFILE HIGH POLARIZATION PURITY DUAL-POLARIZED ANTENNAS

(75) Inventors: John K. Reece; John L. Aden, both of Colorado Springs, CO (US)

(73) Assignee: Xircom Wireless, Inc., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/891,737

(22) Filed: Jun. 25, 2001

Related U.S. Application Data

(63) Continuation of application No. 09/484,058, filed on Jan. 18, 2000, now Pat. No. 6,310,584.

(51) Int. Cl.[7] ..... H01Q 21/00

(52) U.S. Cl. ..... 343/816; 343/795; 343/725

(58) Field of Search ..... 343/816, 812, 343/813, 814, 727, 829, 725, 795, 807

(56) References Cited

U.S. PATENT DOCUMENTS

| | | | |
|---|---|---|---|
| 5,771,024 A | 6/1998 | Reece et al. | 343/725 |
| 5,771,025 A | 6/1998 | Reece et al. | 343/828 |
| 6,121,935 A | 9/2000 | Reece et al. | 343/725 |

*Primary Examiner*—Don Wong
*Assistant Examiner*—Ephrem Alemu
(74) *Attorney, Agent, or Firm*—Lyon & Lyon LLP

(57) ABSTRACT

An antenna system for use in cellular and other wireless communication includes a dual polarized compact antenna array. In one embodiment, the antenna system includes four T-shaped dipole antenna elements mounted on a ground plane, forming a side of a square shaped array. In another embodiment, the antenna system includes seven T-shaped dipole antenna elements mounted on a ground plane to form two side by side square arrays, wherein the square arrays share a common T-shaped dipole antenna element.

10 Claims, 9 Drawing Sheets

LOW PROFILE HIGH POLARIZATION PURITY DUAL-POLARIZED ANTENNAS

This application is a continuation of U.S. patent application Ser. No. 09/484,058 filed on Jan. 18, 2000, now U.S. Pat. No. 6,310,584.

FIELD OF THE INVENTION

This application pertains to the field of antennas and antenna systems and more particularly pertains to antennas for use in wireless communication systems.

BACKGROUND OF THE INVENTION

Urban and suburban RF environments typically possess multiple reflection, scattering, and diffraction surfaces that can change the polarity of a transmitted signal and also create multiple images of the same signal displaced in time (multipath) at the receiver location. Within these environments, the horizontal and vertical components of the signal will often propagate along different paths, arriving at the receiver decorrelated in time and phase due to the varying coefficients of reflection, transmission, scattering, and diffraction present in the paths actually taken by the signal components. The likely polarization angle between an antenna on a handset used in cellular communication systems and the local earth nadir is approximately 60°, which may be readily verified by drawing a straight line between the mouth and ear of a typical human head and measuring the angle that the line makes with respect to the vertical. The resulting offset handset antenna propagates nearly equal amplitude horizontal and vertical signals subject to these varying effects of an urban/suburban RF environment. As a mobile phone user moves about in such an environment, the signal amplitude arriving at the antenna on the base station antenna the handset is communicating with will be a summation of random multiple signals in both the vertical and horizontal polarizations.

The summation of the random multiple signals results in a signal having a Rayleigh fading characterized by a rapidly changing amplitude. Because the signal arriving at the base station often has nearly identical average amplitude in the vertical and horizontal polarizations that are decorrelated in time and/or phase, the base station receiver may choose the polarization with the best signal level at a given time (selection diversity) and/or use diversity combining techniques to achieve a significant increase in the signal to noise ratio of the received signal.

Prior art base station antennas that may be used in a selection diversity or diversity combining system often use two separate linearly polarized antennas. This makes for a bulky and unwieldy arrangement because of the space required for each antenna and its associated hardware. U.S. Pat. No. 5,771,024, the contents of which are incorporated by reference, discloses a compact dual polarized split beam or bi-directional array. There is a need in the art, however, for a compact dual polarized boresight array.

SUMMARY OF THE INVENTION

The present invention is directed to a dual polarized antenna array for use in wireless communication systems. The antenna array of the present invention may be deployed in relatively small, aesthetically appealing packages and, because the arrays are dual polarized, they may be utilized to provide substantial mitigation of multipath effects.

In one aspect, the present invention is directed to an antenna array comprising a first and a second T-shaped dipole antenna mounted on a ground plane and aligned along mutually parallel axes such that the first and second dipoles transmit and receive a first polarization. A third and a fourth T-shaped dipole antennas are mounted on the ground plane and aligned along mutually parallel axes such that the third and fourth dipoles are aligned to transmit and receive a second polarization, the second polarization being orthogonal to the first polarization. A first equal phase power divider is coupled to the first and second T-shaped dipoles and a second equal phase power divider is coupled to the third and fourth T-shaped dipoles. The first and second T-shaped dipoles are preferably spaced apart broadside to one another approximately a half wavelength of an operating frequency. Similarly, the third and fourth T-shaped dipoles are preferably spaced apart broadside to one another approximately a half wavelength of the operating frequency. Such an array produces a boresight beam with equal elevation and azimuth (E and H plane) beamwidths in both the vertical and horizontal polarizations.

In another innovative aspect of the invention, additional antenna elements are added to produce unequal elevation and azimuth beamwidths. For example, a first and a second T-shaped dipole are mounted along a first axis of a ground plane. A third and a fourth T-shaped dipole are mounted along a second axis of the ground plane wherein the first and second axes are mutually parallel. A fifth, sixth, and a seventh T-shaped dipole are mounted on a third, fourth, and fifth axis of the ground plane, respectively, wherein the third, fourth, and fifth axes are orthogonal to the first and second axes. The fifth, sixth, and seventh T-shaped dipoles are positioned between the first and second axes and the sixth antenna element is positioned between the first and second T-shaped dipoles.

In a preferred embodiment, the first and second T-shaped dipoles are spaced apart a half wavelength of an operating frequency along the first axis. Similarly, the third and fourth T-shaped dipoles are spaced apart a half wavelength of the operating frequency along the second axis that, in turn, is spaced apart a half wavelength from the first axis. Finally, the third, fourth, and fifth axes are spaced apart from one another a half wavelength of the operating frequency. If the first and second axes are positioned to extend in the direction defining vertical polarization, the elevation (E plane) beamwidth of the array is 30° whereas the azimuth beamwidth is 65° for both the vertically and the horizontally polarized signals. Additional antenna elements can be added along the first and second axes to further narrow the elevation beamwidth.

DETAILED DESCRIPTION OF THE PREFERRED EMBODIMENTS

Figure 1A:
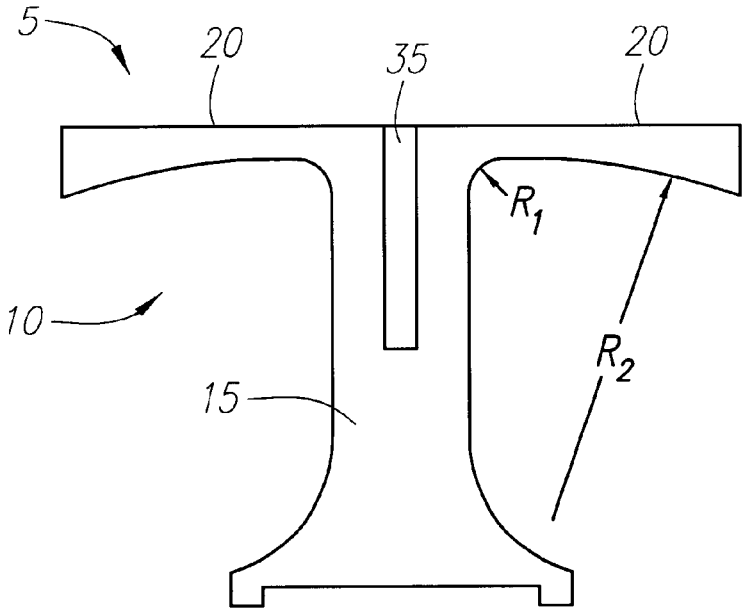
FIG. 1A illustrates a main radiating element of a T-shaped dipole antenna according to the present invention.
Figure 1B:
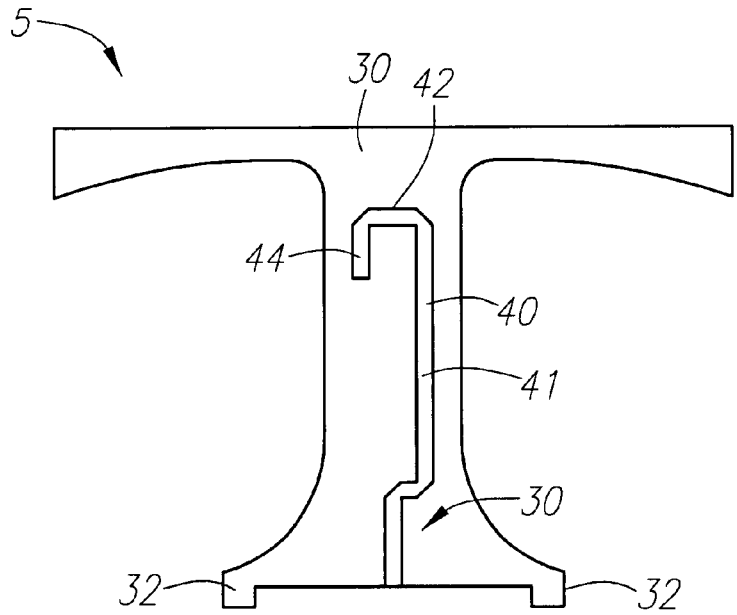
FIG. 1B illustrates of a reactive feed element of the T-shaped dipole antenna shown in FIG. 1A.

Turning to the figures, in one innovative aspect, the present invention is directed to the implementation of a square T-shaped dipole antenna. As shown in FIGS. 1A and 1B, a T-shaped dipole antenna element 5 comprises a large T-shaped radiating element 10 having a longitudinally extending stem 15 and a pair of laterally extending arms 20. T-shaped radiating element 10 and a reactive feed strip 40 are formed on opposite sides of a PC board substrate 30. A reactive feed strip 40 is arranged to produce an antipodal excitation across a longitudinally extending slot 35 in stem 15. Reactive feed strip 40 has a first portion 41 extending from the base of stem 15 to an end along a first side of the slot 35. A second portion 42 of reactive feed strip 40 crosses slot 35 to connect the end of first portion 41 to a third portion 44 of reactive feed strip 40. Third portion 44 extends downwardly on a second side of the slot 35. In this fashion, reactive feed strip 40 includes an antipodal excitation across slot 35, thereby forming a dipole antenna. It will be appreciated that radiating element 10 and reactive feed strip 40 may be and are preferably manufactured by depositing copper cladding in a conventional manner over opposite surfaces of printed circuit board substrate 30, followed by etching portions of the copper cladding away to form radiating element 10 and feed strip 40. Printed circuit board 30 may be manufactured from woven TEFLON® having a thickness of approximately 0.75 millimeters (mm) and a dielectric constant, $\epsilon$, between 3.0 and 3.3.

The upper edge of arms 20 are aligned with the top of stem 15. The lower edge of each arm 20 comprises a first arcuate segment having a radius R1 and a second arcuate segment having a radius R2 wherein the first arcuate segment merges with the edge of the stem 15. In a preferred embodiment, T-shaped radiating element 10 is approximately 71 mm across the top and approximately 50 mm high, stem 15 is approximately 15 mm wide, radius R1 is approximately 5 mm, and radius R2 is approximately 46 mm. In addition, slot 35 is approximately 3.8 mm wide and approximately 24 mm long. Further, reactive feed strip 40 is approximately 1.8 mm wide. Second portion 42 of feed strip 40 is located approximately 10 mm from the top of T-shaped radiating element 10. Third portion 44 has a length of approximately 7.6 mm. While these dimensions are optimal for transmission at a center frequency of 1850 Mega-Hertz (MHz), those of ordinary skill in the art will appreciate that the dimensions of the various elements will vary depending upon the operational characteristics desired for a particular application.

Figure 2:
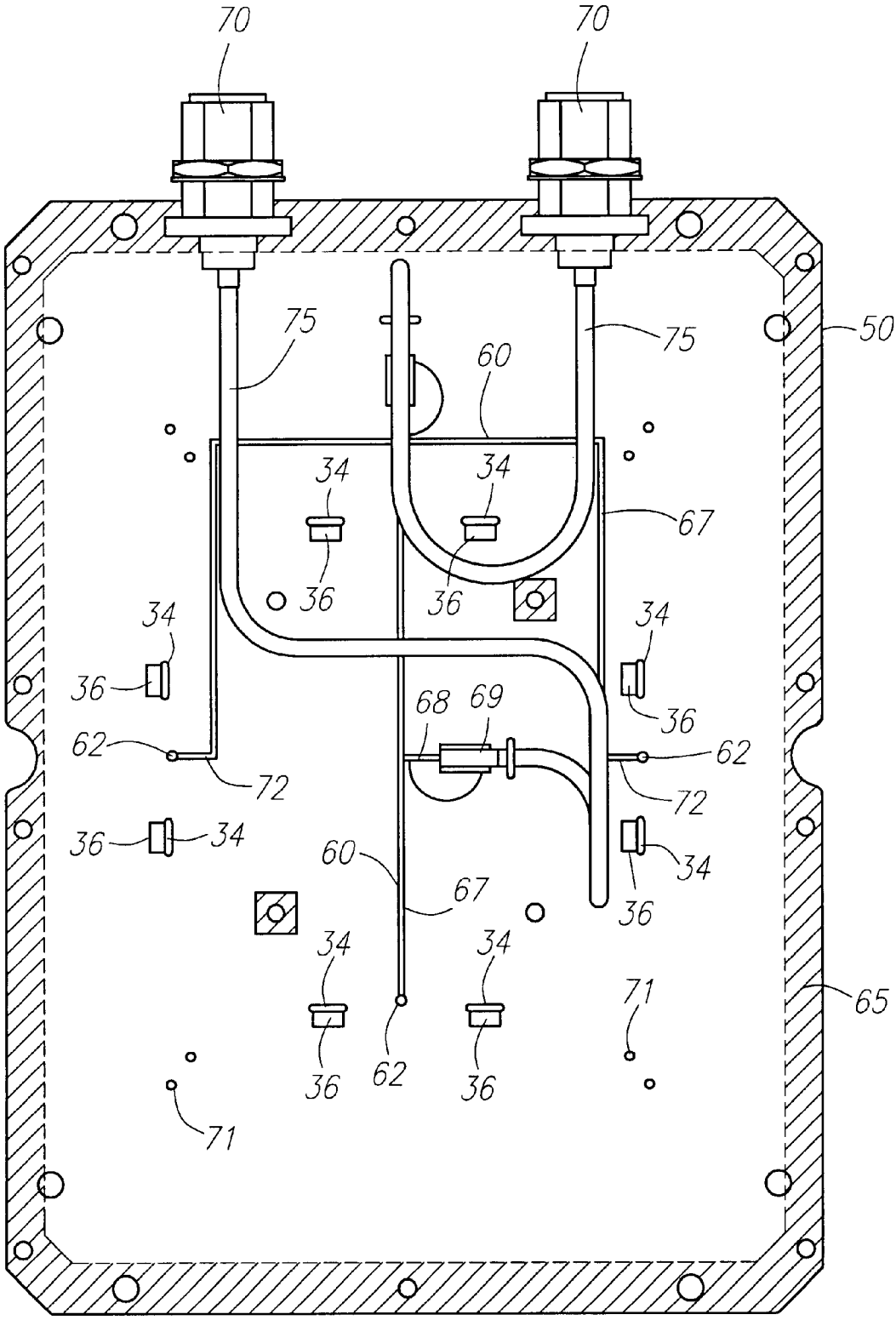
FIG. 2 is a plan view of a bottom surface of a ground plane of a four T-shaped dipole antenna element array according to a preferred embodiment of the invention.
Figure 3:
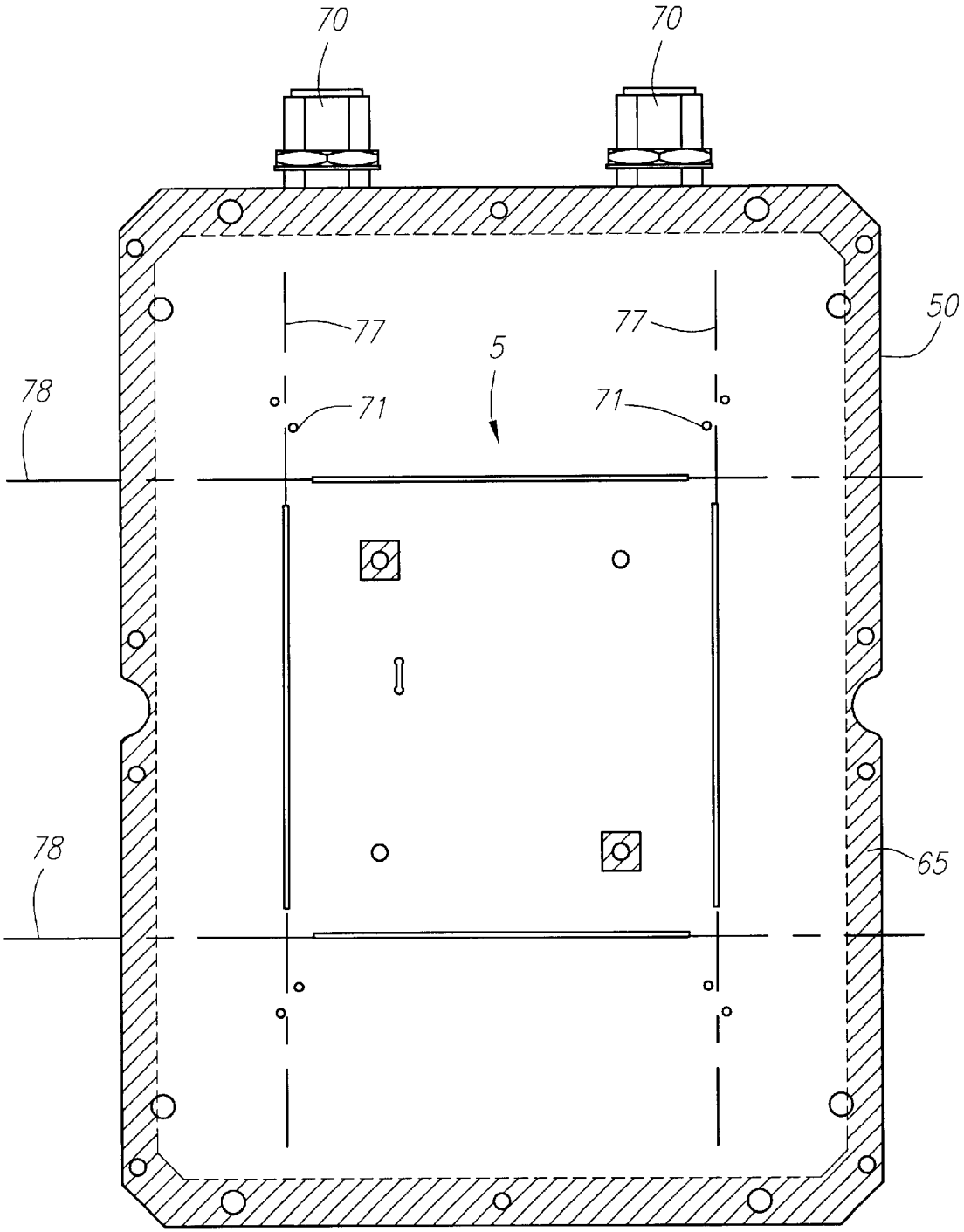
FIG. 3 is a plan view of a top surface of the ground plane of the array of FIG. 2.
Figure 4:
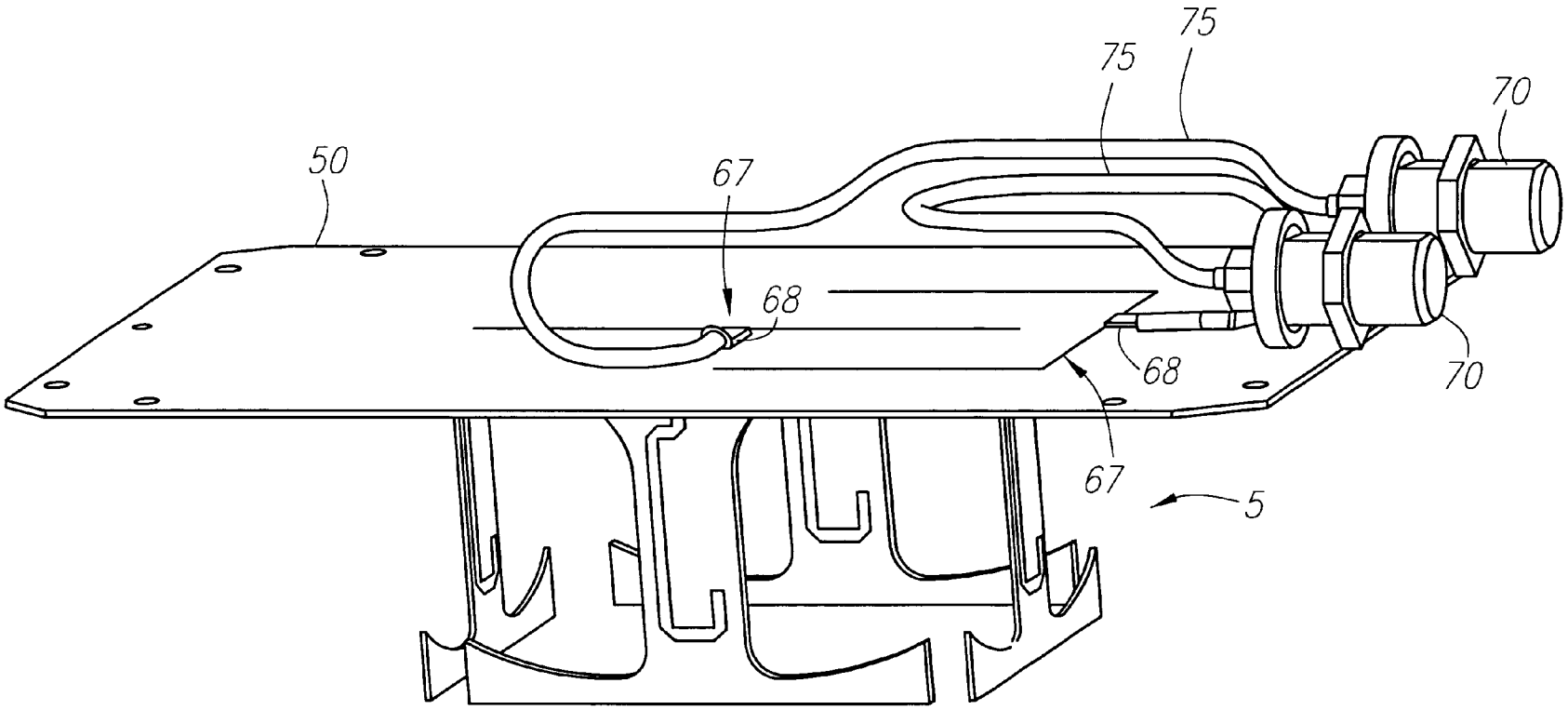
FIG. 4 is a perspective view of the bottom surface of the ground plane of the array of FIG. 2.

Turning now to FIGS. 2, 3, and 4, the present invention is also directed to a dual polarized array of four T-shaped dipole antenna elements 5 arranged in a square configuration on a ground plane 50. T-shaped dipole antenna elements 5 are preferably formed as described with respect to FIGS. 1A and 1B. Ground plane 50 may comprise a printed circuit board substrate having opposing coplanar surfaces, e.g., a bottom surface illustrated in FIG. 2 and a top surface illustrated in FIG. 3, whereon respective layers of copper cladding are deposited. Features on ground plane 50, such as microstrip feed lines 60 are preferably formed by etching away portions of the deposited copper cladding. Dipole antenna elements 5 mount to ground plane 50 by inserting tabs 32 (shown in FIG. 2B) into slots 34. Tabs 32 are soldered to the top surface of ground plane 50 and to grounding pads 36 located on the bottom surface of grounding plane 50.

Reactive feed strips 40 of dipole antenna elements 5 are preferably connected to microstrips 60 by feed pins (not shown) that extend through insulated holes 62. Microstrips 60 are arranged so as to form two equal phase power dividers 67 wherein each power divider 67 is excited at a center pad 68. A power source (not shown) couples to dipole antennas 5 through coaxial connectors 70. Coaxial connectors 70 may be standard type N coax connectors sized to receive 2 mm diameter coaxial cable. The inner conductor of coaxial connector 70 couples to center pads 68 adjacent to center ground pads 69 through wires 75, and ultimately to equal phase power dividers 67. As shown in FIG. 2, the sections of microstrip 60 that couple from center pads 68 to insulated holes 62 are preferably of equal length in each equal phase power divider 67. In this fashion, reactive feed strips 40 of each dipole antenna element 5 attached to a given equal phase power divider 67 are fed in phase with one another because the electrical energy will have traveled the same electrical length at each of reactive feed strips 40.

As shown FIG. 4, four dipole antenna elements 5 are arranged in pairs wherein each pair of antenna elements 5 is coupled to an equal phase power divider 67. A first pair of antenna elements 5 are aligned on mutually parallel axes 77 (shown in FIG. 3). Because the arms 20 of the first pair of dipole antenna elements 5 are aligned on the axes 77, the electric field produced by this first pair of dipole antenna elements 5 will be polarized parallel to axes 77. A second pair of dipole antenna elements 5 are aligned on mutually parallel axes 78, which are orthogonal to axes 77. In this fashion, the electric field produced by the second pair of dipole antenna elements 5 will be orthogonally polarized to the field produced by the first pair of antenna elements 5. Thus, the resulting antenna array forms a square, with two pairs of dipole antenna elements 5 forming opposite sides of the square.

The outer conductors of the coaxial connectors 70 are coupled to the copper cladding coating the upper surface of the ground plane 50. In addition, an array of small perforations (not shown) are distributed around a periphery 65 ground plane 50 and on the center ground pads 69. These perorations and holes 71 act as ground vias, thereby insuring that the respective copper cladding layers form a single, unified ground plane. To provide an impedance match between microstrips 60 and reactive feed strips 40, a quarter wavelength transition section of microstrip line 72 is implemented. In a preferred embodiment, microstrip line 72 is approximately 0.5 mm wide whereas the quarter wavelength transition section is approximately 0.8 mm wide and approximately 24.6 mm long. These dimensions correspond to a center frequency of 1850 MHz. Those of ordinary skill in the art will appreciate that the dimensions would be altered accordingly for different center frequencies.

In order to provide a half-wavelength spacing between identically polarized dipole antenna elements 5, the pair of mutually parallel axes 77 are spaced apart a half wavelength.

Similarly, the pair of mutually parallel axes 78 are also spaced apart a half wavelength. At the preferred operating frequency range between 1710 MHz and 1990 MHz, the axes are spaced apart a distance of substantially 84 mm.

Figure 5:
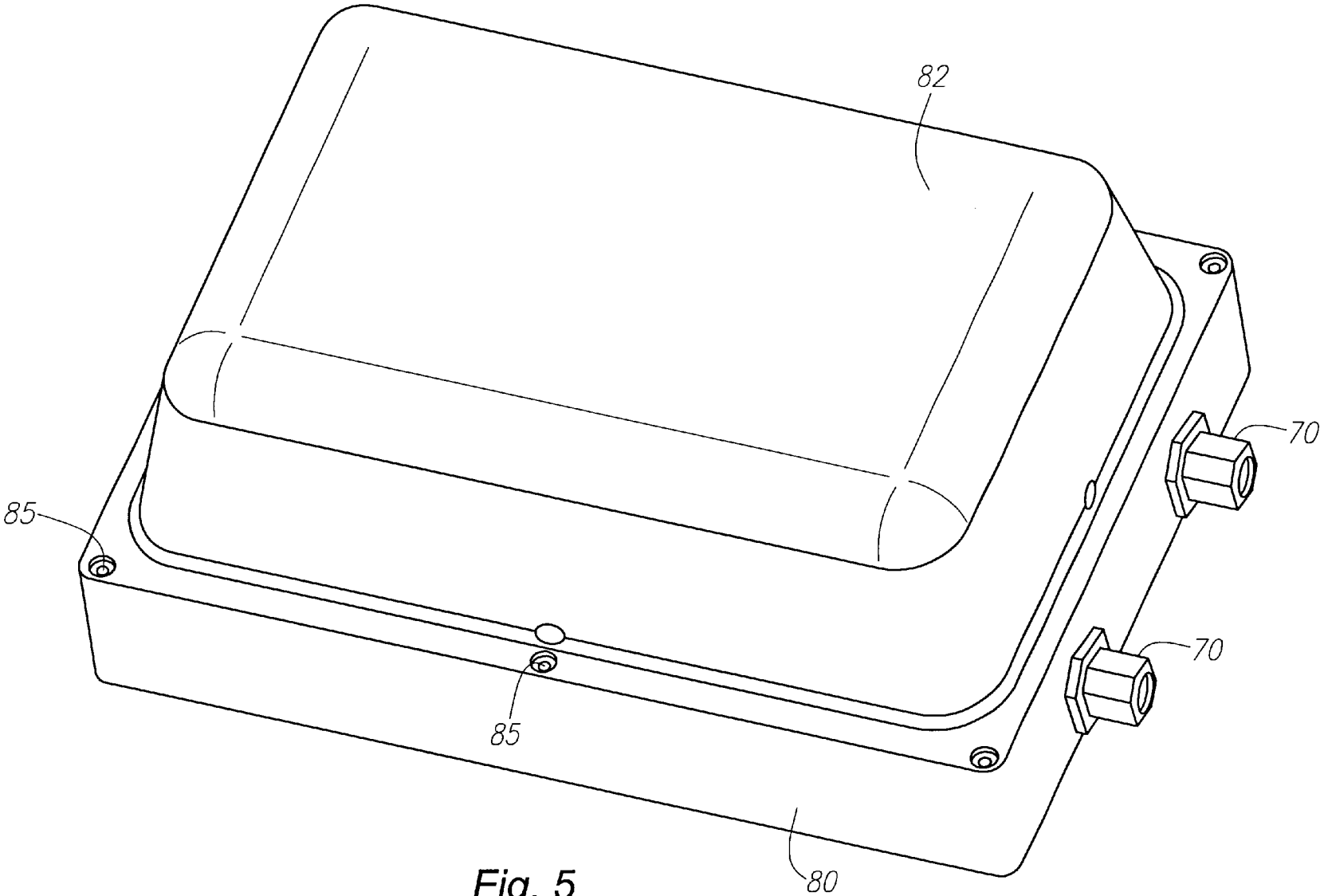
FIG. 5 is a perspective view of an enclosure for the array of FIG. 2.

Turning now to FIG. 5, in a preferred embodiment, the dual polarized four T-shaped antenna element array may be mounted in a casing comprising an aluminum base 80 and a plastic cover 82. Aluminum base 80 is formed such that ground plane 50 containing antenna elements 5 may be mounted within a step (not shown) formed in the outer wall of base 80, and such that ground plane 50 is coupled to base 80 by means of a set of screws (not shown) through periphery 65 of ground plane 50, thereby insuring that base 80 remains grounded during operation of the antenna array. Base 80 also has formed therein a pair of mounts for coaxial connectors 70 and a series of threaded holes for receiving a plurality of screws 85 that secure cover 82 to base 80. Those of ordinary skill in the art will appreciate that, to avoid possible intermodulation effects, cover 82 may be glued to base 80 using an adhesive such as RTV, rather than using screws 85 to secure cover 82 to base 80.

The dual polarized four T-shaped antenna element array embodiment of the present invention produces a single boresight beam projecting orthogonally from ground plane 50 through cover 82. In the field, the antenna element array would be mounted on the wall of a building or on a light pole or other structure. One pair of antenna elements 5, for example that aligned to axes 77, could be aligned with the vertical direction such that antenna elements 5 aligned with axes 77 will transmit and receive vertically polarized fields. Conversely, antenna elements 5 aligned on axes 78 would then transmit and receive horizontally polarized fields.

Figure 6A:
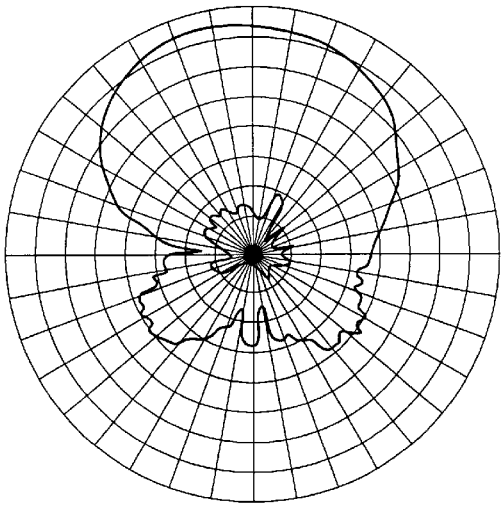
FIGS. 6A, 6B, 6C, and 6D illustrate horizontally and vertically polarized elevation beamwidth (E-Plane) and azimuth beamwidths (H-Plane) cut radiation patterns of the antenna array of FIG. 2.
Figure 6B:
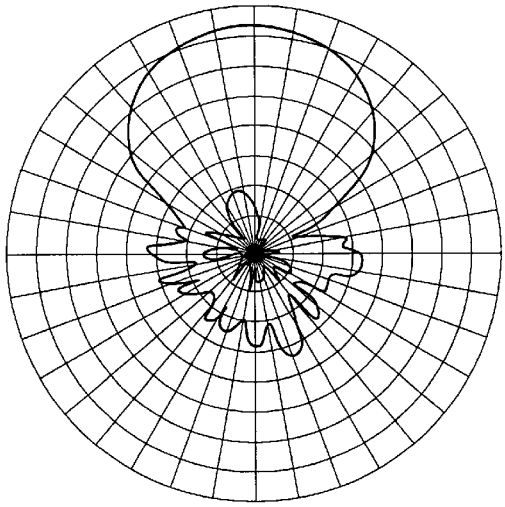
Figure 6C:
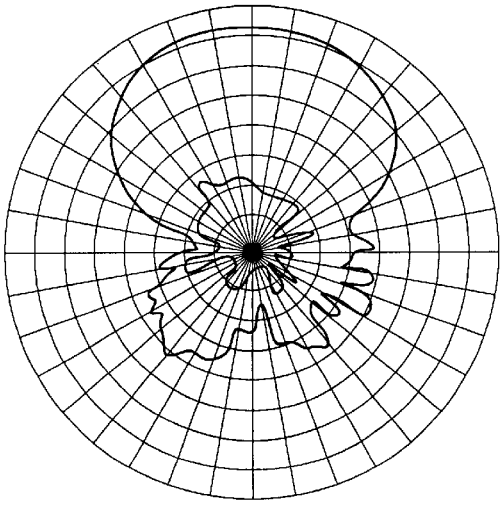
Figure 6D:
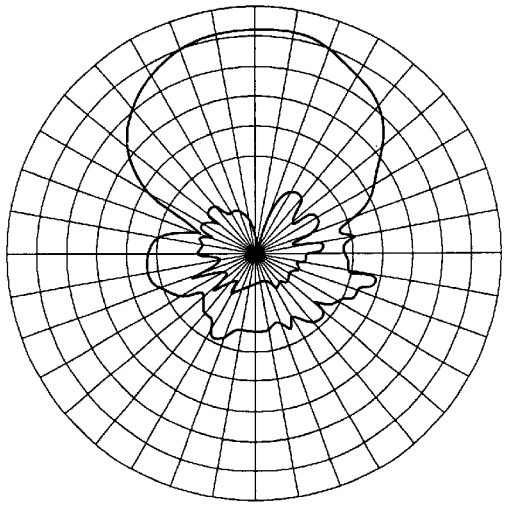

FIG. 6A illustrates a horizontally polarized E-plane cut radiation pattern of the antenna element array of FIG. 4 FIG. 6B illustrates a horizontally polarized H-plane cut radiation pattern of the antenna element array of FIG. 4. FIG. 6C illustrates a vertically polarized E-plane cut radiation pattern of the antenna element array of FIG. 4. FIG. 6D illustrates a vertically polarized H-plane cut radiation pattern of the antenna element array of FIG. 4. Inspection of the FIGS. 6A, 6B, 6C, and 6D reveals that the azimuth and elevation beamwidths for the vertical and horizontal polarized components are approximately 65°.

In another innovative aspect of the invention, the present invention is directed to a dual polarized compact antenna array having unequal elevation and azimuth beamwidths by adding extra T-shaped dipole antenna elements 5 to the square array shown in FIG. 4.

Figure 7:
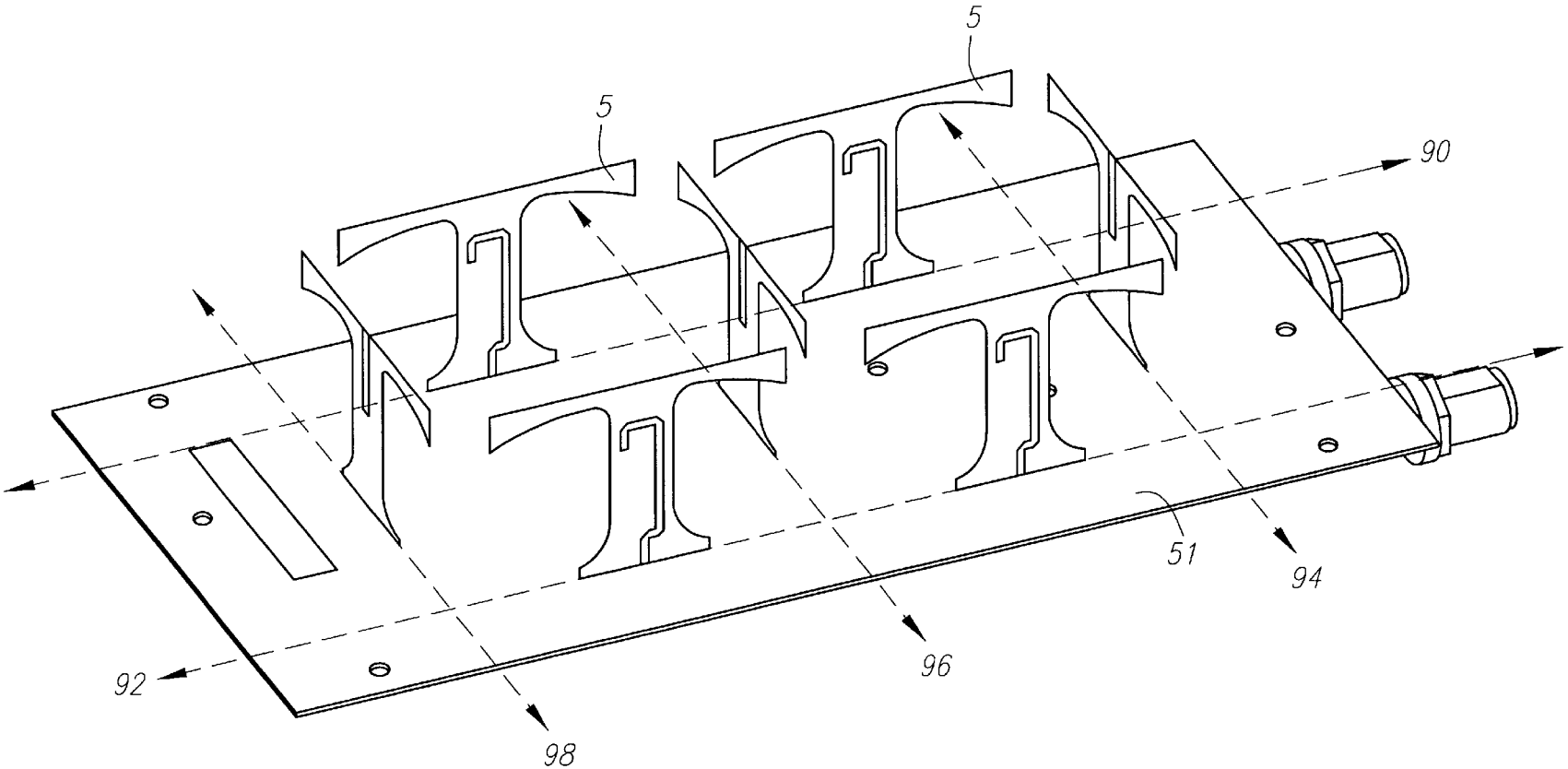
FIG. 7 illustrates a seven T-shaped dipole antenna element array mounted on a ground plane according to a preferred embodiment of the invention.
Figure 8:
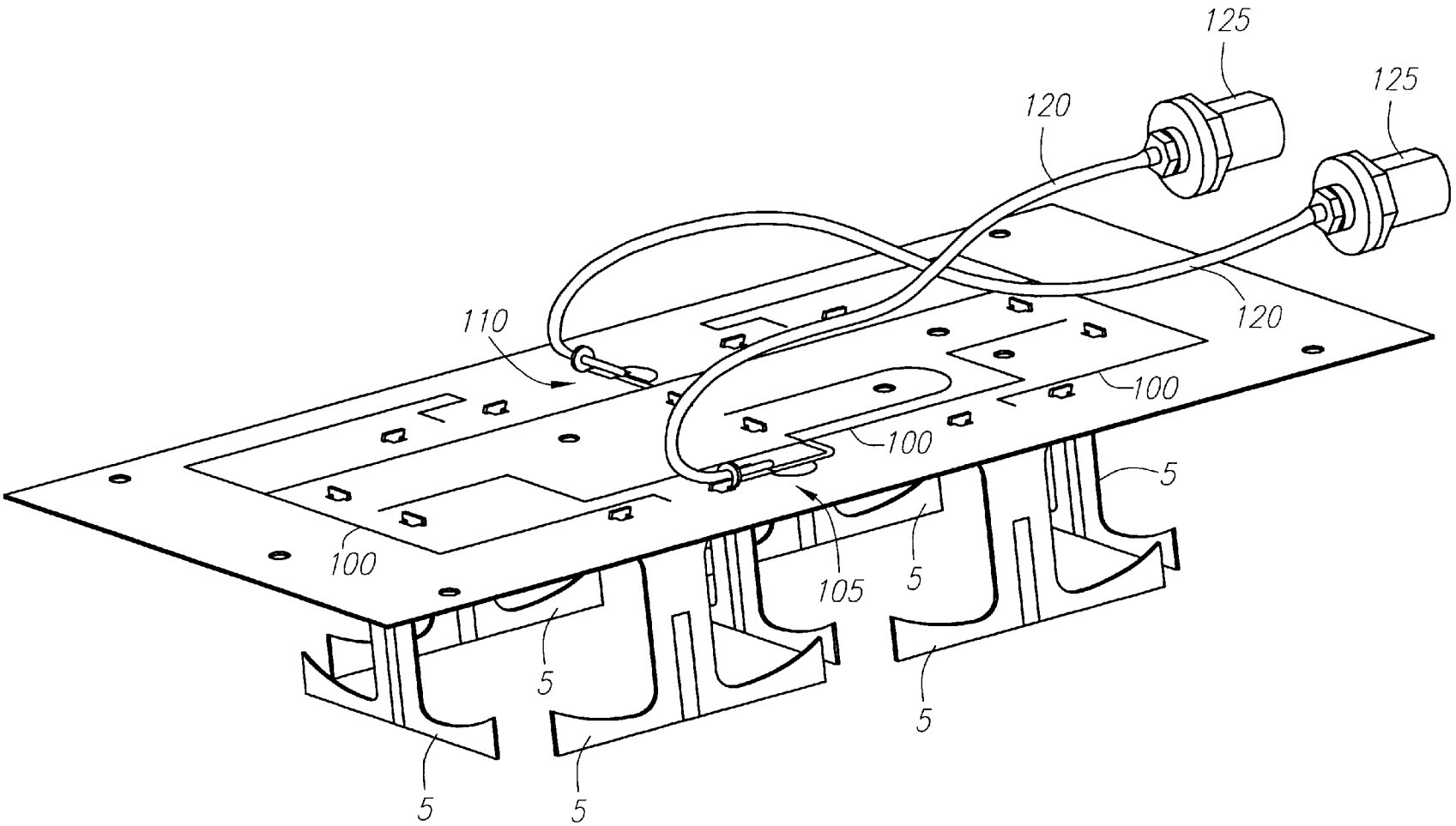
FIG. 8 illustrates a bottom surface of the ground plane of FIG. 7.

Turning now to FIGS. 7 and 8, in one embodiment such an array comprises two vertically polarized T-shaped dipole antenna element pairs and three horizontally polarized T-shaped antenna elements. A first and a second T-shaped dipole antenna elements 5 are mounted along an axis 90 on ground plane 51. A third and a fourth T-shaped dipole antenna elements 5 are mounted along an axis 92 on ground plane 51, wherein axes 90 and 92 are parallel to each other. A fifth, sixth, and a seventh T-shaped dipole antenna elements 5 are mounted along respective axes 94, 96, and 98 on ground plane 51, wherein axes 94, 96, and 98 are orthogonal to axes 92 and 90. Fifth, sixth, and seventh T-shaped dipoles antenna elements 5 are positioned between axes 90 and 92. Sixth antenna element 5 is positioned between first and second antenna elements 5. Because first, second, third, fourth and sixth T-shaped dipole antenna elements 5 are positioned between fifth and seventh dipole antenna elements 5, the resulting antenna array is rectangular, comprising two of the square antenna arrays of FIG. 4, wherein the two square arrays share sixth dipole antenna element 5. Preferably, axes 90 and 92 are spaced apart approximately a half wavelength of the center frequency. First and second T-shaped dipole antenna elements 5 on axis 90 are spaced apart approximately a half wavelength as are third and fourth T-shaped dipole antenna elements 5 on axis 92. Similarly, axes 94, 96, and 98 are spaced apart approximately a half wavelength of the center frequency. At the preferred center frequency of 1850 MHz, this spacing is approximately 84 mm.

Other than having additional T-shaped dipole antenna elements 5, the array of FIGS. 7 and 8 is very similar to the square array described with respect to FIGS. 2, 3, and 4. Specifically, ground plane 51 may comprise a printed circuit board substrate having opposing coplanar surfaces, i.e., a top surface illustrated in FIG. 7 and a bottom surface illustrated in FIG. 8, whereon respective layers of copper cladding are deposited. Features on ground plane 51 such as microstrip feed lines 100 located on the bottom surface are preferably formed by etching away portions of the deposited copper cladding.

The set of horizontally polarized T-shaped dipole antenna elements 5 are fed by a first equal phase power divider 105. Similarly, the set of vertically polarized T-shaped dipole antenna elements are fed by a second equal phase power divider 110. Each of equal phase power dividers 105 and 110 comprises equal lengths of microstrip feed lines 100 attaching to the various T-shaped dipole antenna elements 5. Equal phase power dividers 105 and 110 are coupled through wires 120 to center conductors of coaxial connectors 125.

The outer conductors of the coaxial connectors 125 are coupled to the copper cladding coating the upper surface of the ground plane 51. In addition, as described with respect to the square antenna array of FIGS. 3 and 4, an array of small perforations (not shown) are distributed around the periphery of the ground plane 51 as well as on ground pads. The perforations act as ground vias, thereby insuring the respective copper cladding layers forming a single, unified ground plane. To provide an impedance match between microstrips 100 and reactive feed strips 40, a quarter wavelength transition section of microstrip line is implemented. Ground plane 51 with the mounted T-shaped dipole antenna array is secured within a housing similar to the housing depicted in FIG. 5. It is to be noted that the present invention produces a dual polarized antenna array such that the labeling of antenna elements as vertically or horizontally polarized is arbitrary and depends upon the ultimate orientation of the housing with respect to the horizon.

Figure 9A:
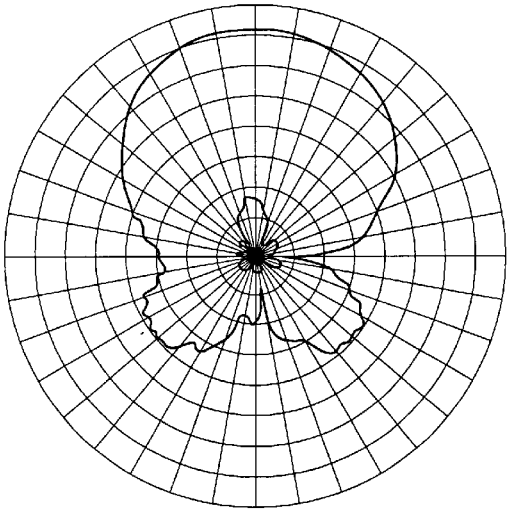
FIGS. 9A, 9B, 9C, and 9D illustrate horizontally and vertically polarized elevation beamwidth (E-Plane) and azimuth beamwidths (H-Plane) cut radiation patterns of the antenna array of FIG. 7.
Figure 9B:
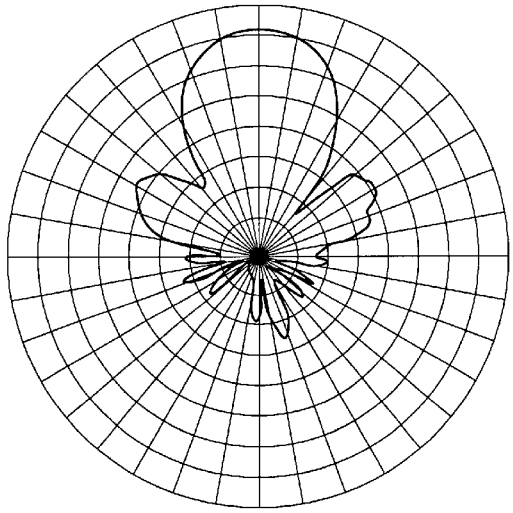
Figure 9C:
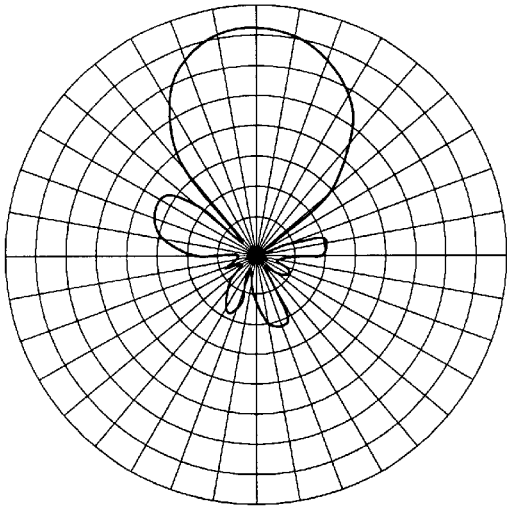
Figure 9D:
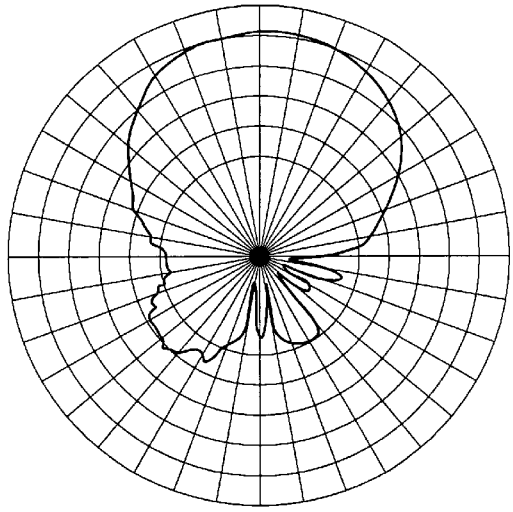

FIG. 9A illustrates a horizontally polarized E-plane cut radiation pattern of the array of FIG. 7. FIG. 9B illustrates a horizontally polarized H-plane cut radiation pattern of the array of FIG. 7. FIG. 9C illustrates a vertically polarized E-plane cut radiation pattern of the array of FIG. 7. FIG. 9D illustrates a vertically polarized H-plane cut radiation pattern of the array of FIG. 7. Inspection of the FIGS. 9A, 9B, 9C, and 9D reveals that the azimuth and elevation beamwidths for the vertical and horizontal polarized components are unequal. The vertically polarized component has an elevation and azimuth beamwidth of approximately 30°, whereas the horizontally polarized component has an approximately 30° elevation beamwidth and an approximately 65° azimuth beamwidth.

While those of ordinary skill in the art will appreciate that this invention is amenable to various modifications and alternative embodiments, specific examples thereof have been shown by way of example in the drawings and are herein described in detail. It is to be understood, however, that the invention is not to be limited to the particular forms or methods disclosed, but to the contrary, the invention is to broadly cover all modifications, equivalents, and alternatives encompassed by the spirit and scope of the appended claims.

What is claimed is:

1. An antenna array, comprising:

a ground plane;

a first and a second T-shaped dipole antenna elements mounted along a first pair of mutually parallel axes of the ground plane;

a third and a fourth T-shaped dipole antenna elements mounted along a second pair of mutually parallel axes of the ground plane orthogonal to the first pair of mutually parallel axes;

a first power divider coupled to the first and second T-shaped dipole antenna elements; and a second power divider coupled to the third and fourth T-shaped dipole antenna elements.

2. The antenna array of claim 1, wherein:

the first and second T-shaped dipole antenna elements are aligned to transmit and receive a first polarization; and the third and fourth T-shaped dipole antenna elements are aligned to transmit and receive a second polarization orthogonal to the first polarization.

3. The antenna array of claim 1, wherein:

the ground plane includes a printed circuit copper cladding thereon; and the first and second power dividers include microstrip lines formed from copper cladding deposited on the printed circuit.

4. The antenna array of claim 1, each of the first, second, third, and fourth T-shaped dipole antenna elements comprising:

a stem having a base, a top, and a pair of side edges;

a pair of laterally extending arms attached to the stem, each of the pair of laterally extending arms having a top edge and a bottom edge, the bottom edge of each arm including a first arcuate segment merging with a corresponding side edge of the stem and having a radius R1, and a second arcuate segment having a radius R2 greater than R1; and a reactive feed strip extending along the stem.

5. The antenna array of claim 4, wherein the first arcuate segment forms a quarter circle.

6. The antenna array of claim 5, wherein:

R1 is approximately 5 millimeters; and

R2 is approximately 46 millimeters.

7. The antenna array of claim 4, wherein:

the top edge of each of the pair of laterally extending arms is aligned with the top of stem;

the stem has a longitudinally extending slot; and the reactive feed strip extends along the stem by having a first portion extending from the base to a first point a first side of the slot, a second extending from a second point adjacent a second side of the slot towards the base, and a third portion extending between the first point and the second point.

8. The antenna array of claim 7, wherein:

wherein the stem has a length of approximately 50 millimeters; and the slot has a width of approximately 3.8 millimeters and extends longitudinally from the top of the stem a length of approximately 24 millimeters.

9. The antenna array of claim 8, wherein the first, second, third, and fourth T-shaped dipole antenna elements form a square array, in which:

the first and second T-shaped dipole antenna elements are broadside to one another and spaced apart approximately 84 millimeters; and the third and fourth T-shaped dipole antenna elements are broadside to one another and spaced apart approximately 84 millimeters, the T-shaped dipole antenna elements thereby forming a square array.

10. The antenna array of claim 1, further comprising a housing, the housing including:

a pair of coaxial connectors, a first one of the pair of coaxial connectors being coupled to the first power divider, and a second one of the pair of coaxial connectors being coupled to the second power divider;

a base providing a mounting for the ground plane and a mounting for the pair of coaxial connectors; and a cover adapted to be coupled to the base.

* * * * *